US007377399B2

(12) United States Patent
Lane et al.

(10) Patent No.: US 7,377,399 B2
(45) **Date of Patent: *May 27, 2008**

(54) INVERTING VACUUM PANELS FOR A PLASTIC CONTAINER

(75) Inventors: Michael T. Lane, Brooklyn, MI (US); Richard J. Steih, Britton, MI (US); Daniel W. Gamber, Lakeland, TN (US); Randall S. Brown, Kennesaw, GA (US); Rohit V. Joshi, Ann Arbor, MI (US)

(73) Assignee: AMCOR Limited, Abbotsford, Victoria (AU)

( * ) Notice: Subject to any disclaimer, the term of this patent is extended or adjusted under 35 U.S.C. 154(b) by 232 days.

This patent is subject to a terminal disclaimer.

(21) Appl. No.: 11/146,163

(22) Filed: Jun. 6, 2005

(65) Prior Publication Data

US 2005/0247664 A1 Nov. 10, 2005

Related U.S. Application Data

(63) Continuation-in-part of application No. 10/361,356, filed on Feb. 10, 2003, now Pat. No. 6,920,992.

(51) Int. Cl.
*B65D 1/02* (2006.01)
*B65D 1/46* (2006.01)

(52) U.S. Cl. ..... 215/381; 215/383; 220/673; 220/675

(58) Field of Classification Search ..... 215/379, 215/381–384; 220/666, 669, 675, 609, 673
See application file for complete search history.

(56) References Cited

U.S. PATENT DOCUMENTS

| | | | | |
|---|---|---|---|---|
| 3,325,031 | A | 6/1967 | Singier | |
| 4,805,788 | A | 2/1989 | Akiho | |
| 4,863,046 | A | 9/1989 | Collette et al. | |
| 5,060,453 | A | 10/1991 | Alberghini et al. | |
| 5,141,121 | A | 8/1992 | Brown et al. | |
| 5,178,289 | A | 1/1993 | Krishnakumar et al. | |
| 5,199,588 | A | 4/1993 | Hayashi | |
| 5,238,129 | A | 8/1993 | Ota | |
| 5,303,834 | A | 4/1994 | Krishnakumar et al. | |
| 5,337,909 | A | 8/1994 | Vailliencourt | |
| 5,472,105 | A | 12/1995 | Krishnakumar et al. | |
| 5,499,730 | A | 3/1996 | Harbour | |
| 5,690,244 | A | 11/1997 | Darr | |
| 5,704,503 | A * | 1/1998 | Krishnakumar et al. | 215/381 |
| 5,810,195 | A | 9/1998 | Sim | |
| 5,908,128 | A | 6/1999 | Krishnakumar et al. | |

(Continued)

FOREIGN PATENT DOCUMENTS

JP 05065158 A 3/1993

(Continued)

*Primary Examiner*—Sue A. Weaver
(74) *Attorney, Agent, or Firm*—Harness, Dickey & Pierce, P.L.C.

(57) ABSTRACT

A sidewall portion of a plastic container adapted for vacuum pressure absorption. The sidewall portion including generally rectangular shaped vacuum panels equidistantly spaced about the container. The vacuum panels having, at least in part, a convex shaped surface and a series of equidistantly spaced indents disposed therein. The vacuum panels being moveable to accommodate vacuum forces generated within the container thereby decreasing the volume of the container.

32 Claims, 12 Drawing Sheets

U.S. PATENT DOCUMENTS

| | | | | |
|---|---|---|---|---|
| 5,971,184 | A | 10/1999 | Krishnakumar et al. | |
| 6,044,996 | A | 4/2000 | Carew et al. | |
| 6,044,997 | A | 4/2000 | Ogg | |
| 6,092,688 | A * | 7/2000 | Eberle et al. | 220/669 |
| 6,273,282 | B1 | 8/2001 | Ogg et al. | |
| 6,494,333 | B2 | 12/2002 | Sasaki et al. | |
| 6,497,333 | B1 | 12/2002 | Ellis et al. | |
| 6,513,669 | B2 | 2/2003 | Ozawa et al. | |
| 6,920,992 | B2 * | 7/2005 | Lane et al. | 215/381 |
| 2001/0022291 | A1 * | 9/2001 | Shimada et al. | 215/382 |
| 2002/0008077 | A1 | 1/2002 | Lane et al. | |
| 2004/0050851 | A1 | 3/2004 | Ilzuka et al. | |

FOREIGN PATENT DOCUMENTS

| | | | |
|---|---|---|---|
| JP | 05310239 | A | 11/1993 |
| JP | 672423 | * | 3/1994 |
| JP | 2005132452 | * | 5/2005 |
| WO | WO 00/50309 | | 8/2000 |
| WO | WO 00/68095 | | 11/2000 |

* cited by examiner

INVERTING VACUUM PANELS FOR A PLASTIC CONTAINER

CROSS-REFERENCE TO RELATED APPLICATION

This application is a continuation-in-part of U.S. Ser. No. 10/361,356, filed Feb. 10, 2003, U.S. Pat. No. 6,920,992 issued on Jul. 26, 2005 and commonly assigned.

TECHNICAL FIELD OF THE INVENTION

This invention generally relates to side panels for plastic containers that retain a commodity, and in particular a liquid commodity. More specifically, this invention relates to inverting vacuum panels formed in a plastic container that allow for significant absorption of vacuum pressures without unwanted deformation in other portions of the container.

BACKGROUND OF THE INVENTION

As a result of environmental and other concerns, plastic containers, more specifically polyester and even more specifically polyethylene terephthalate (PET) containers, are now being used more than ever to package numerous commodities previously packaged in glass containers. Manufacturers and fillers, as well as consumers, have recognized that PET containers are lightweight, inexpensive, recyclable and manufacturable in large quantities.

Manufacturers currently supply PET containers for various liquid commodities, such as juice and isotonic beverages. Suppliers often fill these liquid products into the containers while the liquid product is at an elevated temperature, typically between 68° C.-96° C. (155° F.-205° F.) and usually at approximately 85° C. (185° F.). When packaged in this manner, the hot temperature of the liquid commodity sterilizes the container at the time of filling. The bottling industry refers to this process as hot filling, and containers designed to withstand the process as hot-fill or heat-set containers.

The hot filling process is acceptable for commodities having a high acid content, but not generally acceptable for non-high acid content commodities. Nonetheless, manufacturers and fillers of non-high acid content commodities desire to supply their commodities in PET containers as well.

For non-high acid commodities, pasteurization and retort are the preferred sterilization process. Pasteurization and retort both present an enormous challenge for manufactures of PET containers in that heat-set containers cannot withstand the temperature and time demands required of pasteurization and retort.

Pasteurization and retort are both processes for cooking or sterilizing the contents of a container after filling. Both processes include the heating of the contents of the container to a specified temperature, usually above approximately 70° C. (approximately 1550° F.), for a specified length of time (20-60 minutes). Retort differs from pasteurization in that retort uses higher temperatures to sterilize the container and cook its contents. Retort also applies elevated air pressure externally to the container to counteract pressure inside the container. The pressure applied externally to the container is necessary because a hot water bath is often used and the overpressure keeps the water, as well as the liquid in the contents of the container, in liquid form, above their respective boiling point temperatures.

PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \frac{\rho - \rho_a}{\rho_c - \rho_a} \times 100$$

where $\rho$ is the density of the PET material; $\rho_a$ is the density of pure amorphous PET material (1.333 g/cc); and $\rho_c$ is the density of pure crystalline material (1.455 g/cc).

Container manufactures use mechanical processing and thermal processing to increase the PET polymer crystallinity of a container. Mechanical processing involves orienting the amorphous material to achieve strain hardening. This processing commonly involves stretching a PET preform along a longitudinal axis and expanding the PET preform along a transverse or radial axis to form a PET container. The combination promotes what manufacturers define as biaxial orientation of the molecular structure in, the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 120° C.-130° C. (approximately 248° F.-266° F.), and holding the blown container against the heated mold for approximately three (3) seconds. Manufacturers of PET juice bottles, which must be hot-filled at approximately 85° C. (185° F.), currently use heat setting to produce PET bottles having an overall crystallinity in the range of approximately 25-35%.

After being hot-filled, the heat-set containers are capped and allowed to reside at generally the filling temperature for approximately five (5) minutes at which point the container, along with the product, is then actively cooled prior to transferring to labeling, packaging, and shipping operations. The cooling reduces the volume of the liquid in the container. This product shrinkage phenomenon results in the creation of a vacuum within the container. Generally, vacuum pressures within the container range from 1-300 mm Hg less than atmospheric pressure (i.e., 759 mm Hg −460 mm Hg). If not controlled or otherwise accommodated, these vacuum pressures result in deformation of the container, which leads to either an aesthetically unacceptable container or one that is unstable.

In many instances, container weight is correlated to the amount of the final vacuum present in the container after this fill, cap and cool down procedure, that is, the container is made relatively heavy to accommodate vacuum related forces. Similarly, reducing container weight, i.e., "lightweight" the container, while providing a significant cost savings from a material standpoint, requires a reduction in the amount of the final vacuum. Typically, the amount of the final vacuum can be reduced through various processing options such as the use of nitrogen dosing technology, minimize headspace or reduce fill temperature. One drawback with the use of nitrogen dosing technology however is that the maximum line speeds achievable with the current technology is limited to roughly 200 containers per minute. Such slower line speeds are seldom acceptable. Additionally, the dosing consistency is not yet at a technological level to achieve efficient operations. Minimizing headspace requires more precession during filling, again resulting in slower line speeds. Reducing fill temperature is equally disadvantageous as it limits the type of commodity suitable for the container.

Typically, container manufacturers accommodate vacuum pressures by incorporating structures in the container sidewall. Container manufacturers commonly refer to these structures as vacuum panels. Traditionally, these paneled areas have been semi-rigid by design, unable to accommodate the high levels of vacuum pressures currently generated, particularly in lightweight containers.

Thus, there is a need for an improved container sidewall that readily distorts inwardly in a controlled manner under vacuum pressure from the hot-filling process thereby accommodating for this vacuum pressure without undesirable deformation in the container sidewall while allowing for a lightweight container that accommodates a higher fill temperature and is capable of reducing panel surface area. It is therefore an object of this invention to provide such a container sidewall.

SUMMARY OF THE INVENTION

Accordingly, this invention provides for inverting vacuum panels for a plastic container which maintain aesthetic and mechanical integrity during any subsequent handling after being hot-filled and cooled to ambient having a structure that is designed to distort inwardly in a controlled manner so as to allow for significant absorption of vacuum pressures without unwanted deformation.

The present invention includes a sidewall portion of a plastic container, the container having an upper portion, the sidewall portion, and a base. The upper portion includes an opening defining a mouth of the container. The sidewall portion extends from the upper portion to the base. The sidewall portion includes generally rectangular shaped vacuum panels defined in at least part by an upper portion, a central portion, and a lower portion each having an underlying surface with a series of equidistantly spaced indents formed therein. At least the central portion underlying surface having a generally convex shape in cross section. The vacuum panels being moveable to accommodate vacuum forces generated within the container thereby decreasing the volume of the container.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE PREFERRED EMBODIMENTS

Figure 1:
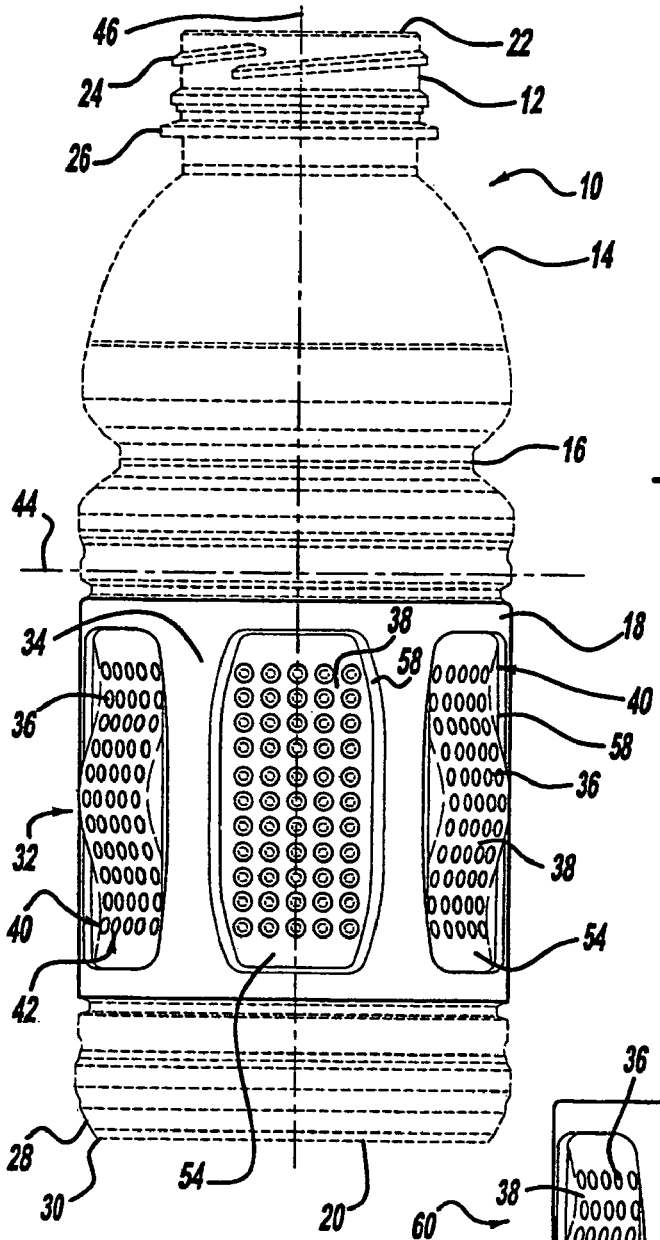
FIG. 1 is an environmental view of inverting vacuum panels constructed in accordance with the teachings of a preferred embodiment of the present invention and shown as formed on a sidewall portion of a plastic container.

The following description of the preferred embodiments is merely exemplary in nature, and is in no way intended to limit the invention or its application or uses.

As discussed above, to accommodate vacuum forces during cooling of the contents within a heat-set container, containers generally have a series of vacuum panels around their sidewall. Traditionally, these vacuum panels have been semi-rigid and incapable of preventing unwanted distortion elsewhere in the container, particularly in lightweight containers.

Referring now to the drawings, there is depicted a sidewall portion of a plastic container embodying the concepts of the present invention. The drawings show the sidewall portion of the present invention, generally identified by reference numeral 18, adapted to cooperate with a specific plastic container 10. However, the teachings of the present invention are more broadly applicable to sidewall portions for a large range of plastic containers.

Before addressing the construction and operation of the sidewall portion 18 of the present invention, a brief understanding of the exemplary plastic container 10 shown in the drawings is appropriate. The environmental view of FIG. 1 illustrates the plastic container 10 of the present invention including a finish 12, a shoulder region 14, a waist segment 16, the sidewall portion 18 and a base 20. The inventors have specifically designed the plastic container 10 for retaining a commodity during a thermal process, such as a high-temperature pasteurization or retort. The plastic container 10 may be useful for retaining a commodity during other thermal processes as well.

The plastic container 10 of the present invention is a blow molded, biaxially oriented container with a unitary construction from a single or multi-layer material such as polyethylene terephthalate (PET) resin. Alternatively, one may manufacture the plastic container 10 by other methods and from other conventional materials including, for example, polyethylene naphthalate (PEN), and a PET/PEN blend or copolymer. A person of ordinary skill in the art will understand appropriate manufacturing methods of plastic containers made of PET polymers, having a unitary construction, and generally incorporating the present invention.

The finish 12 of the plastic container 10 includes a portion defining an aperture or mouth 22, a threaded region 24 and a support ring 26. The aperture 22 allows the plastic container 10 to receive a commodity while the threaded region 24 provides a means for attachment of a similarly threaded closure or cap (not shown). Alternatives may include other suitable devices that engage the finish 12 of the plastic container 10. Accordingly, the closure or cap (not shown) engages the finish 12 to provide preferably a hermetical seal of the plastic container 10. The closure or cap (not shown) is preferably of a plastic or metal material conventional to the closure industry and suitable for subsequent thermal processing, including high temperature pasteurization and retort. The support ring 26 may be used to carry or orient the preform (the precursor to the plastic container 10 ) (not shown) through and at various stages of manufacture. For example, the preform may be carried by the support ring 26, the support ring 26 may be used to aid in positioning the preform in the mold, or an end consumer may use the support ring 26 to carry the plastic container 10 once manufactured.

Integrally formed with the finish 12 and extending downward therefrom is the shoulder region 14. The shoulder region 14 merges into the waist segment 16. The waist segment 16 provides a transition between the shoulder region 14 and the sidewall portion 18. The sidewall portion 18 extends downward from the waist segment 16 to the base 20. The specific construction of the sidewall portion 18 allows for manufacture of a significantly lightweight container. Such a container 10 can exhibit at least a 10% reduction in weight from those of current stock containers. Such a container 10 is also capable of accommodating high fill temperatures and reduced panel surface area.

The base 20 of the plastic container 10, which extends inward from the sidewall portion 18, generally includes a chime 28 and a contact ring 30. The contact ring 30 is itself that portion of the base 20 that contacts a support surface that in turn supports the container 10. As such, the contact ring 30 may be a flat surface or a line of contact generally circumscribing, continuously or intermittently, the base 20. The base 20 functions to close off the bottom portion of the plastic container 10 and, together with the shoulder region 14, the waist segment 16, and the sidewall portion 18, to retain the commodity.

The plastic container 10 is preferably heat-set according to the above-mentioned process or other conventional heat-set processes. To accommodate vacuum forces, the sidewall portion 18 of the present invention adopts a novel and innovative construction. Generally, the sidewall portion 18 of the present invention includes vacuum panels 32 formed therein. As illustrated in the figures, the vacuum panels 32 have a generally rectangular shape and have a generally equidistant spacing around the sidewall portion 18 of the container 10. While such spacing is preferred, other factors such as labeling requirements or the incorporation of grip features into the container may require spacing other than equidistant. The container illustrated in FIG. 1 shows a container 10 having six (6) vacuum panels 32. The inventors equally contemplate that less than six (6) vacuum panels 32, such as three (3), be required. Defined between adjacent vacuum panels 32 are lands or columns 34. Lands or columns 34 provide structural support and rigidity to the sidewall portion 18 of the container 10.

As shown in FIGS. 1-6, the vacuum panels 32 of the present invention include a series of indents or dimples 36 formed therein and throughout the vacuum panels 32. Viewed in elevation, the indents 36 are generally circular in shape. The area defined between adjacent indents 36 are lands 38. As illustrated, in the preferred embodiment, the indents 36 are generally spaced equidistantly apart from one another, and arranged in horizontal rows 40 and vertical columns 42. The horizontal rows 40 of indents 36 are generally parallel to a radial axis 44 of the container 10, while the vertical columns 42 of indents 36 are generally parallel to a central longitudinal axis 46 of the container 10.

Figure 13:
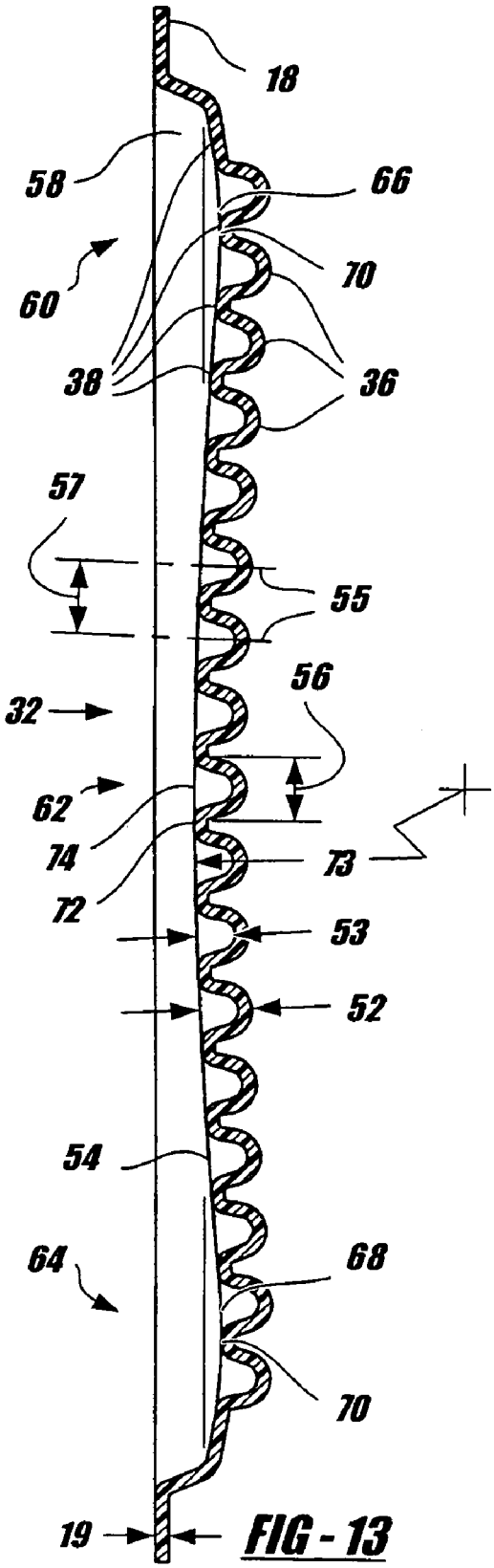
FIG. 13 is a cross-sectional view of the inverting vacuum panel, taken generally along the line 13-13 of FIG. 11, otherwise substantially similar to FIG. 3, the inverting vacuum panel shown as formed on the container sidewall, the container as molded and empty.

Each indent or dimple 36 has a centerline 55 (see FIG. 13). A pitch 57 is measured between adjacent centerlines 55 of indents 36. While the pitch 57 is generally equidistant, the pitch 57 along horizontal rows 40 may be different from the pitch 57 along vertical columns 42. Generally, the pitch 57 for containers having a nominal capacity between approximately 12 fluid ounces (355 cc) and approximately 64 fluid ounces (1893 cc) is between approximately 0.030 inch (0.76 mm) and approximately 0.090 inch (2.29 mm). While the above-described geometry of indents 36 is the preferred embodiment, a person of ordinary skill in the art will readily understand that other geometrical arrangements are feasible. Such alternative geometrical arrangements may increase the amount of absorption.

Continuing with FIGS. 3-6, the indents 36, when viewed in cross section, are generally in the shape of a truncated or rounded cone having a lower most surface or point 48 and side surfaces 50. Side surfaces 50 are generally planar and slope inward toward the central longitudinal axis 46 of the container 10. The exact shape of the indents 36 can vary greatly depending on various design criteria. An indent 36 overall depth dimension 52 between the lower most surface or point 48 of the indents 36 and an underlying surface 54 of the vacuum panel 32 is approximately equal to a dimension 56 measuring the length of indents 36. The indent or dimple 36 has an inside depth dimension 53 that is less than a wall thickness 19 of the sidewall portion 18 (see FIG. 13, not drawn to scale). Those skilled in the art of container manufacture realize that the wall thickness 19 of the container 10 varies considerably depending where a technician takes a measurement within the container 10. Accordingly, the overall depth dimension 52 may vary slightly from one indent 36 to another indent 36 while the inside depth dimension 53 remains substantially consistent. Generally, the inside depth dimension 53 for containers having a nominal capacity between approximately 12 fluid ounces (355 cc) and approximately 64 fluid ounces (1893 cc) is between approximately 0.047 inch (1.19 mm) and approximately 0.067 inch (1.70 mm).

The wall thickness 19 of the vacuum panel 32 must be thin enough to allow the vacuum panel 32 to be flexible and function properly. Accordingly, the material thickness at the lower most surface or point 48 of the indents 36 is greater than the material thickness at the lands 38. Typically, the wall thickness 19 at the lower most surface or point 48 is between approximately 0.005 inch (0.127 mm) to approximately 0.015 inch (0.381 mm), while the wall thickness 19 at the lands 38 is between approximately 0.004 inch (0.102 mm) and approximately 0.014 inch (0.356 mm).

Vacuum panel 32 also includes, and is surrounded by, a perimeter wall or edge 58. The perimeter wall or edge 58 defines the transition between the sidewall portion 18 and the underlying surface 54, and is an upstanding wall approximately 0 inch (0 mm) to approximately 0.25 inch (6.35 mm) in height. Accordingly, the depth of the vacuum panel 32 is approximately 0 inch (0 mm) to approximately 0.25 inch (6.35 mm). As is illustrated in the figures, the perimeter wall or edge 58 is shorter at the center of the vacuum panel 32 and is taller at the top and bottom of the vacuum panel 32. One should note that the perimeter wall or edge 58 is a distinctly identifiable structure between the sidewall portion 18 and the underlying surface 54. The perimeter wall or edge 58 provides strength to the transition between the sidewall portion 18 and the underlying surface 54. This transition must be abrupt in order to maximize the local strength as well as to form a geometrically rigid structure. The resulting localized strength increases the resistance to creasing in the sidewall portion 18.

Figure 3:
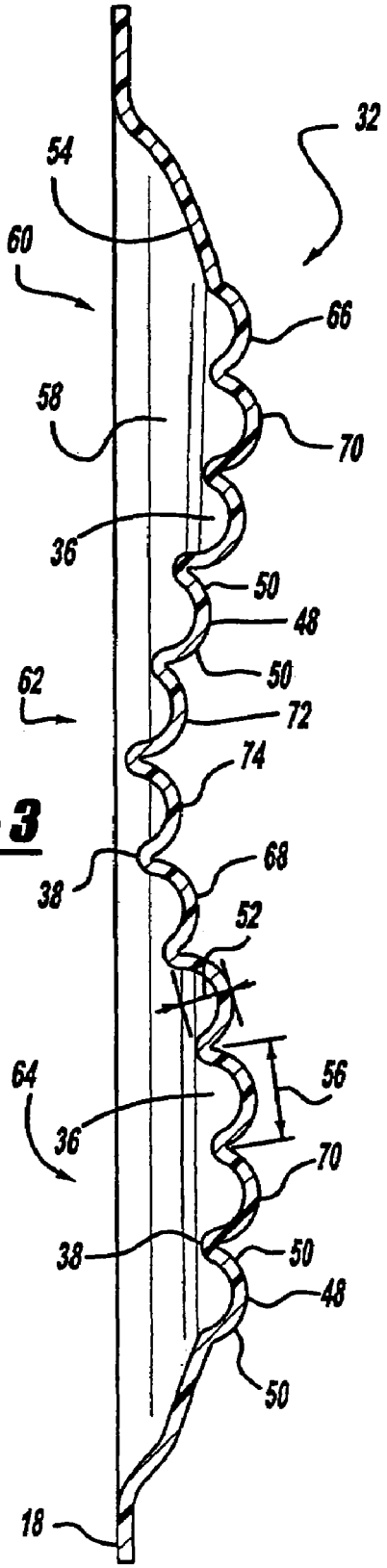
FIG. 3 is a cross-sectional view of the inverting vacuum panel, taken generally along the line 3-3 of FIG. 2, the inverting vacuum panel shown as formed on the container sidewall, the container as molded and empty.
Figure 18:
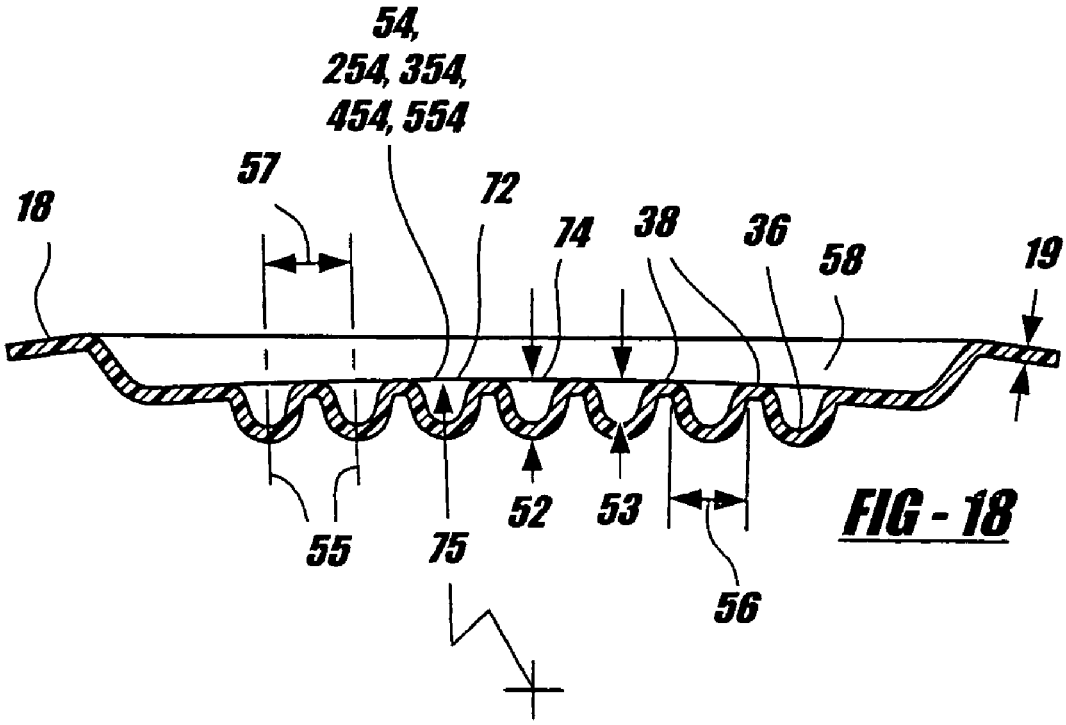
FIG. 18 is a cross-sectional view of the inverting vacuum panel, taken generally along the line 18-18 of FIG. 11, otherwise substantially similar to FIG. 4, the inverting vacuum panel shown as formed on the container sidewall, the container as molded and empty.

Vacuum panels 32 further include an upper portion 60, a central portion 62, and a lower portion 64. The underlying surface 54 of the upper portion 60, the central portion 62, and the lower portion 64 are unitary with one another and together generally have a compound curve shape. As illustrated in FIGS. 3 and 13, as molded, in cross section, the upper portion 60 and the lower portion 64 form generally concave surfaces 66 and 68. An apex 70 of each such concave surfaces 66 and 68 measures (for a typical container 10 having a nominal capacity of approximately 20 fluid ounces (591 cc)) between approximately 1.07 inches (27.178 mm) and approximately 1.47 inches (37.338 mm) from the central longitudinal axis 46 of the container 10. Similarly, as molded, in cross section, the central portion 62 forms a generally convex surface 72. An apex 74 of the convex surface 72 measures (for a typical container 10 having a nominal capacity of approximately 20 fluid ounces (591 cc)) between approximately 1.16 inches (29.464 mm) and approximately 1.56 inches (39.624 mm) from the central longitudinal axis 46 of the container 10. Accordingly, the apex 70 is closer to the central longitudinal axis 46 than the apex 74 by approximately 0.090 inch (2.286 mm). Although a greater difference in length is possible, this difference typically is from approximately zero to approximately 0.090 inch (2.286 mm). Furthermore, central portion 62 in cross section, as illustrated in FIG. 13, has an underlying radius 73 suitable to establish an appropriate difference between the position of apex 70, of the upper concave surface 66 and the lower concave surface 68, and the relative position of apex 74 of the convex surface 72. Similarly, FIG. 18 illustrates a cross-sectional view relating to FIG. 13 of convex surface 72 having an underlying radius 75 suitable, and likely different from radius 73, to establish a desired blending with edge or perimeter wall 58.

Figure 5:
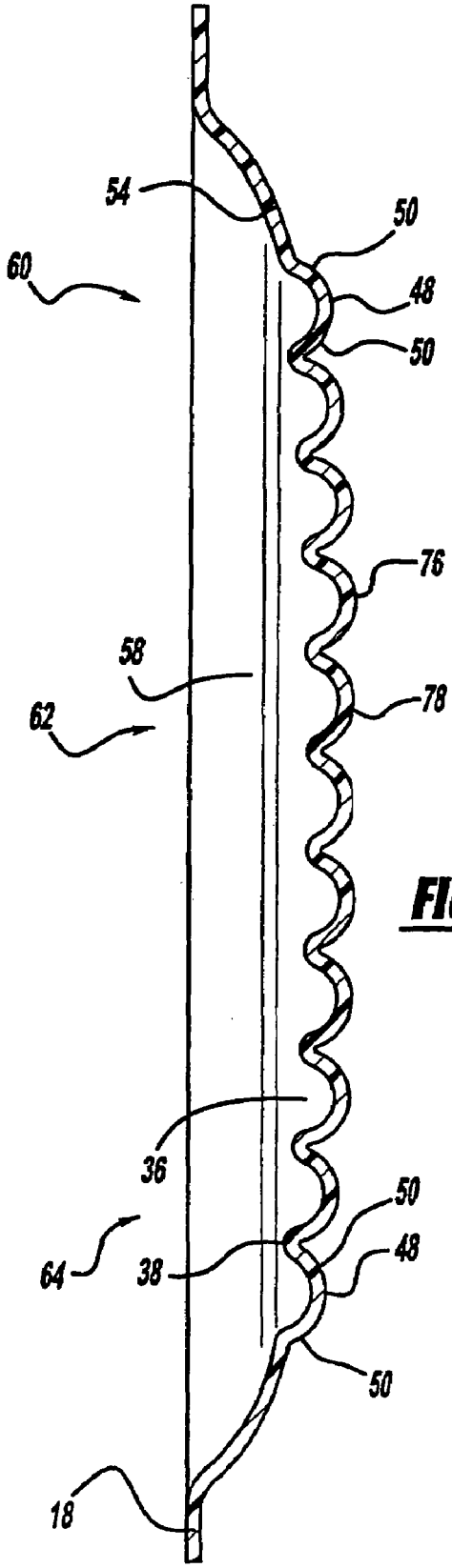
FIG. 5 is a cross-sectional view of the inverting vacuum panel, taken generally along the line 5-5 of FIG. 2, the inverting vacuum panel shown as formed on the container sidewall, the container being filled and sealed.
Figure 6:
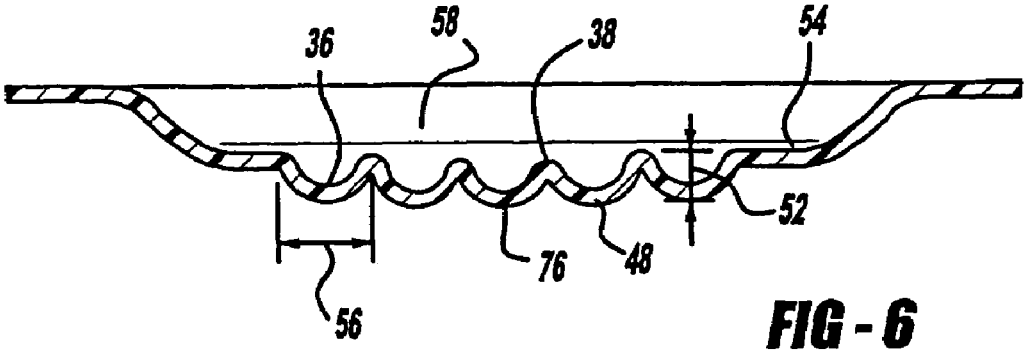
FIG. 6 is a cross-sectional view of the inverting vacuum panel, taken generally along the line 6-6 of FIG. 2, the inverting vacuum panel shown as formed on the container sidewall, the container being filled and sealed.

Upon filling, capping, sealing and cooling, as illustrated in FIGS. 5 and 6, the central portion 62, as well as the upper portion 60 and the lower portion 64 to a lesser extent, are pulled radially inward, toward the central longitudinal axis 46 of the container 10, displacing volume, as a result of vacuum forces. In this position, the upper portion 60, the central portion 62 and the lower portion 64 of the vacuum panel 32, in cross section, form a second concave surface 76. An apex 78 of the second concave surface 76 measures between approximately 0.89 inch (22.606 mm) and approximately 1.39 inches (35.306 mm) from the central longitudinal axis 46 of the container 10. Accordingly, upon filling, capping, sealing, and cooling, the concave surfaces 66 and 68, and to a lesser extent the convex surface 72, virtually disappear with the second concave surface 76 generated in their place. All of the above dimensions are taken from a typical 20 fluid ounce (591 cc) hot-fillable container having a radius of approximately 1.42 inches (36.068 mm). The inventors anticipate that comparable dimensions are attainable for containers of varying shapes and sizes.

The greater the difference between the measurement from the apex 74 to the central longitudinal axis 46, and the measurement from the apex 78 to the central longitudinal axis 46, the greater the potentially achievable displacement of volume. Said differently, the greater the inward radial movement between the apex 74 and the apex 78, the greater the achievable displacement of volume. The invention avoids deformation of the sidewall portion 18 by controlling and limiting the deformation to within the vacuum panels 32. Accordingly, the thin, flexible, generally compound curve geometry of the vacuum panels 32 of the sidewall portion 18 of the container 10 allows for greater volume displacement versus containers having a semi-rigid sidewall portion.

Figure 7:
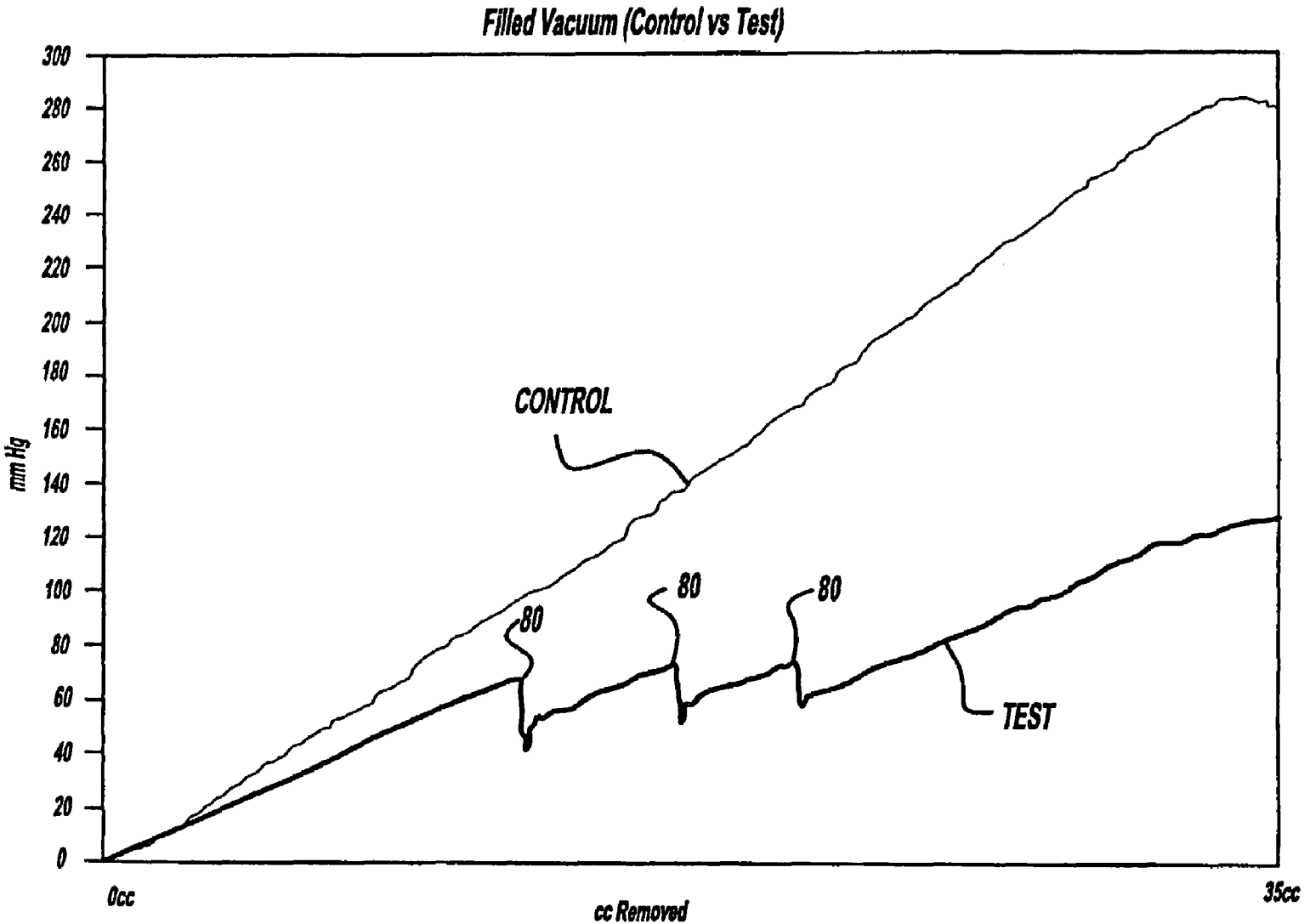
FIG. 7 is a chart comparing the vacuum pressures of a current stock container with those of a container embodying the principles of the present invention.

The chart illustrated in FIG. 7 exhibits the significant benefit of the present invention through the reduction of vacuum pressure. As previously discussed, the less vacuum pressure the container is subjected to, the greater the ability to lightweight the container. As illustrated, a current stock control container exhibits a maximum vacuum pressure of approximately 280 mm Hg. For the same amount of volume displacement as the current stock control container, the container 10 having vacuum panels 32 exhibits less vacuum pressure, having a maximum vacuum pressure of approximately 100 mm Hg. Accordingly, as is shown in FIG. 7, the container 10 having vacuum panels 32 can displace the same amount of volume as the current stock control container at significantly less vacuum pressure thus allowing for the container 10 having vacuum panels 32 to be significantly lighter in weight. The test data exhibited in FIG. 7 is associated with a container having three (3) vacuum panels 32. Each vacuum panel 32 offers a reduction in vacuum pressure. The three (3) significant drops in vacuum pressure from peaks 80 correspond to each vacuum panel 32 separately deflecting radially inward. As each vacuum panel 32 defects radially inward, the amount of vacuum pressure drops significantly.

Figure 8:
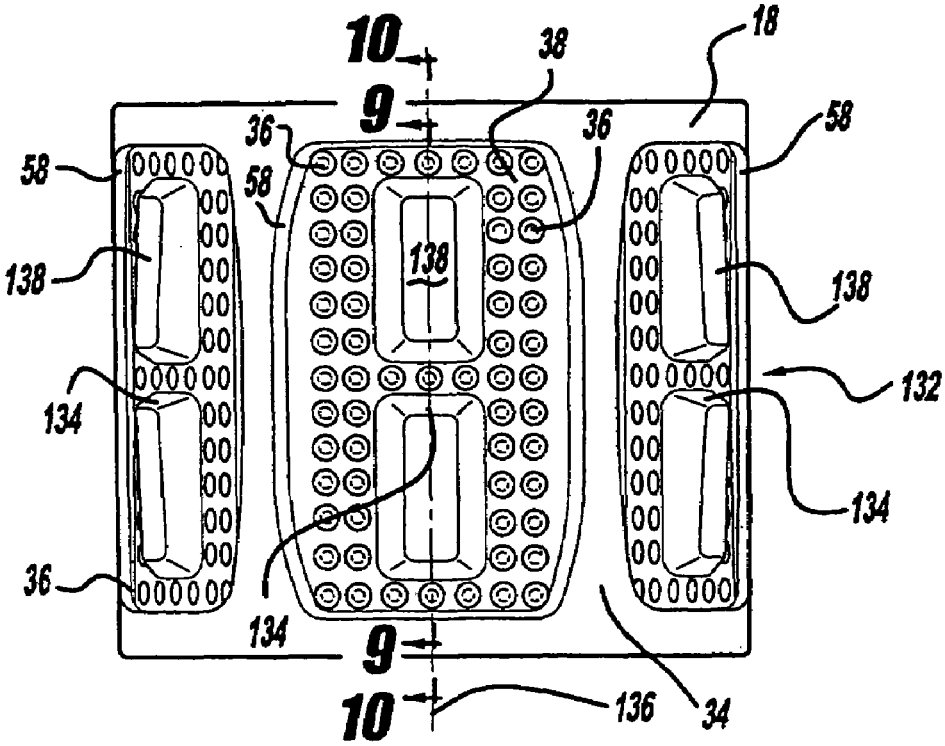
FIG. 8 is an elevational view of one of the inverting vacuum panels of an alternative embodiment of the present invention.
Figure 9:
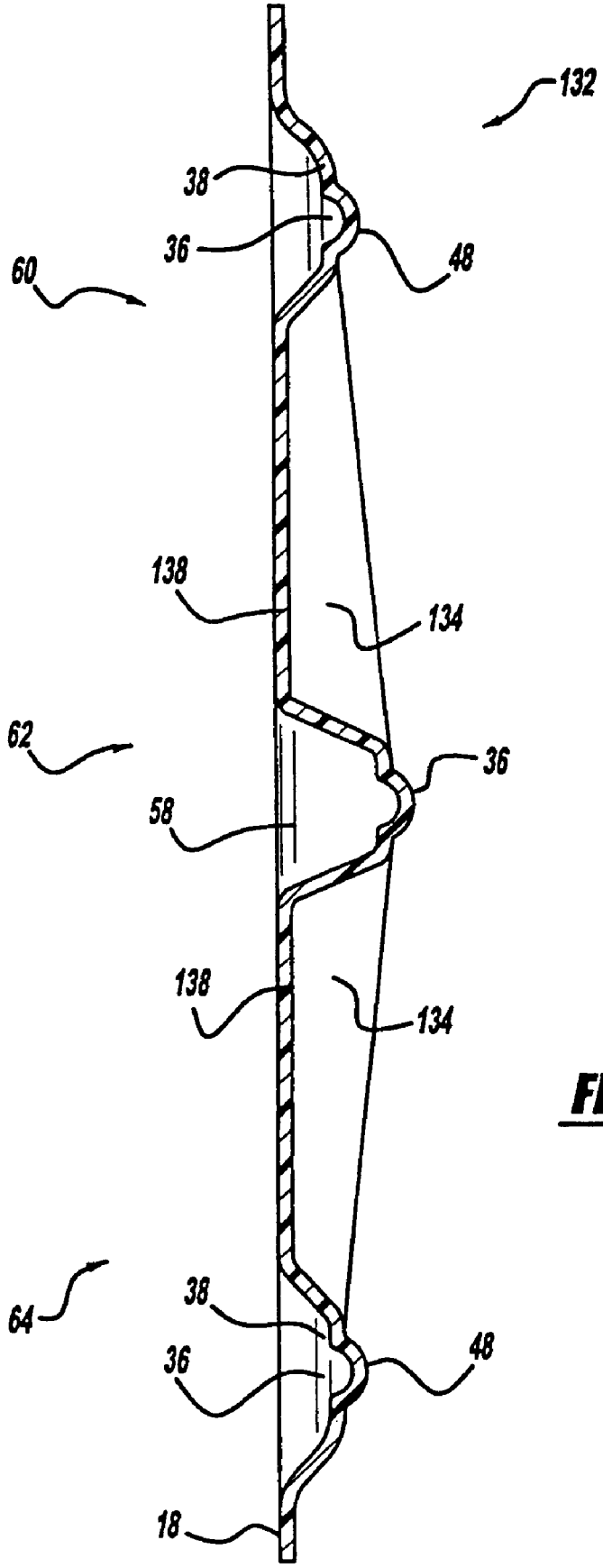
FIG. 9 is a cross-sectional view of the inverting vacuum panel, taken generally along the line 9-9 of FIG. 8, the inverting vacuum panel shown as formed on the container sidewall, the container being filled and sealed.
Figure 10:
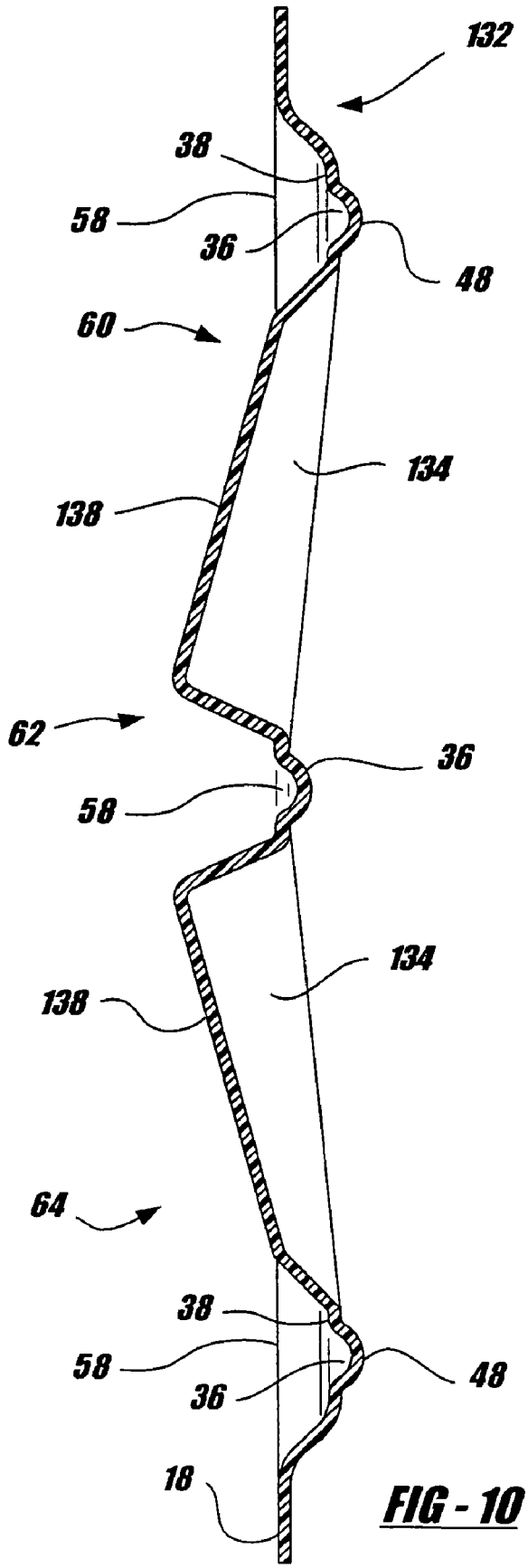
FIG. 10 is a cross-sectional view of the inverting vacuum panel, taken generally along the line 10-10 of FIG. 8, the inverting vacuum panel shown as formed on the container sidewall, the container as molded and empty.

FIGS. 8, 9 and 10 illustrate an alternate embodiment of a vacuum panel 132 according to the invention. Similar reference numerals will describe similar components between the two embodiments. As with the previous embodiment of vacuum panels 32, the vacuum panels 132 include, but are not limited to, indents 36, lands 38, perimeter wall or edge 58, upper portion 60, central portion 62, and lower portion 64. The vacuum panels 132 differ primarily from the previous embodiment of vacuum panels 32 in that they include islands 134.

The islands 134 are located generally on a central longitudinal axis 136 of the vacuum panel 132. While the figures show two islands 134, it is contemplated that less than or more than this amount is feasible. The islands 134, in cross section, are generally trapezoidal in shape having an upper surface 138. The islands 134 offer further support for container labels. Accordingly, as illustrated in FIG. 9, when the vacuum panel 132 fully inverts, the upper surface 138 of the islands 134 is level with the outer label surface of the sidewall portion 18 of the container 10 thereby offering additional support for the container label. Similarly, as illustrated in FIGS. 8 and 10, when the container 10 is molded and empty, the vacuum panel 132 is not fully inverted, and the upper surface 138 of the islands 134 is not level with the outer surface of the sidewall portion 18.

FIGS. 11-19 illustrate vacuum panel embodiments 32, 232, 332, 432, and 532, and include the series of indents or dimples 36, as also illustrated in FIGS. 1-6. The indents 36 preferably are substantially circular in shape; however, those skilled in the art will recognize that other shapes, such as, generally oval, square, rectangular, or diamond-like are equally appropriate. Between and adjacent to the indents 36 are lands 38. Land 38 is also adjacent to and merges with edge or perimeter wall 58.

Figure 2:
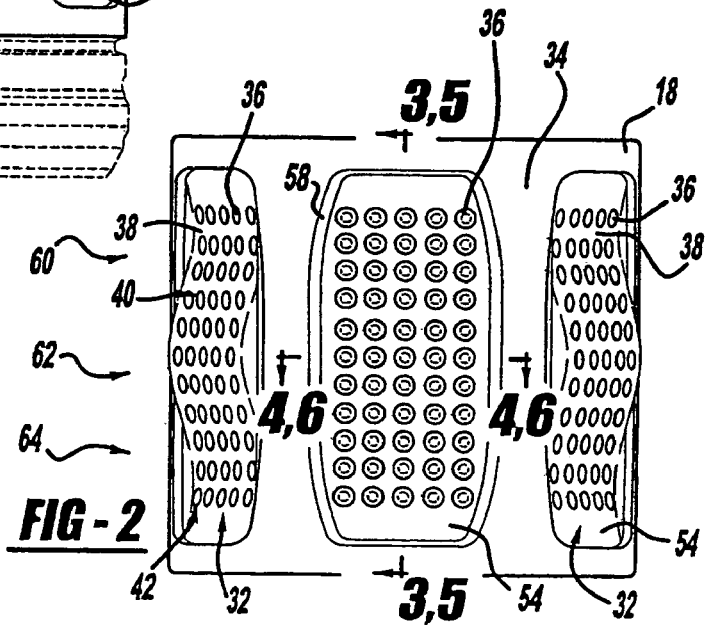
FIG. 2 is an elevational view of one of the inverting vacuum panels of FIG. 1 further illustrating the present invention.
Figure 4:
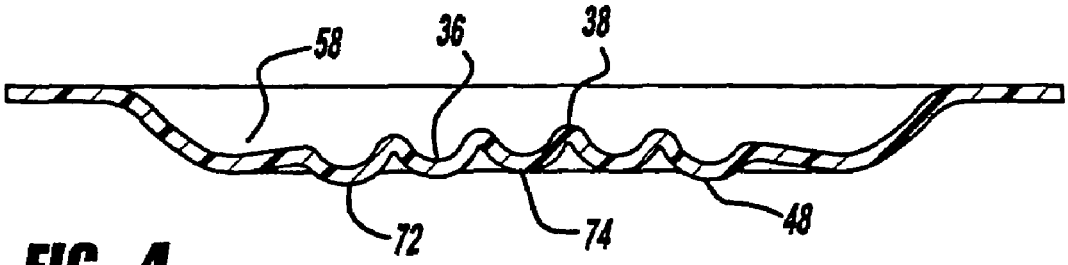
FIG. 4 is a cross-sectional view of the inverting vacuum panel, taken generally along the line 4-4 of FIG. 2, the inverting vacuum panel shown as formed on the container sidewall, the container as molded and empty.
Figure 11:
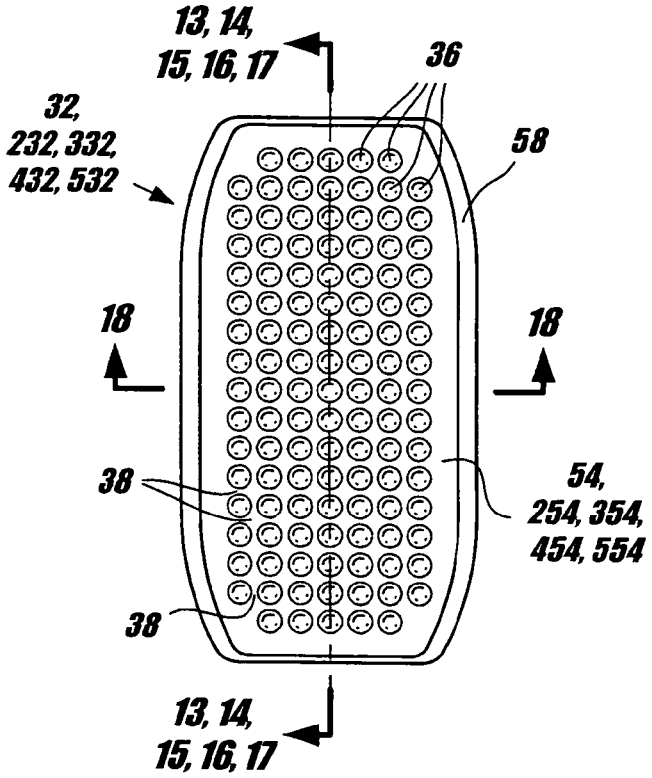
FIG. 11 is an elevational view of a single inverting vacuum panel, otherwise substantially similar to FIG. 2.

FIGS. 11, 13, and 18, while including additional detail, substantially correspond with FIGS. 2, 3, and 4. FIGS. 12, 14-17, and 19-23 illustrate additional embodiments envisioned by the inventors. The additional embodiments described below provide subtle differences in performance and efficiency causing any one embodiment to be more suitable for a specific container purpose than any other embodiment. The inventors envision such container variables as container diameter to height relationship, container capacity, percentage of container headspace to container nominal capacity, number of vacuum panels employed, specific temperature of beverage during hot-filling process, specific container weight, specific container wall thickness, and so forth are capable of dictating one's choice of embodiment.

Figure 14:
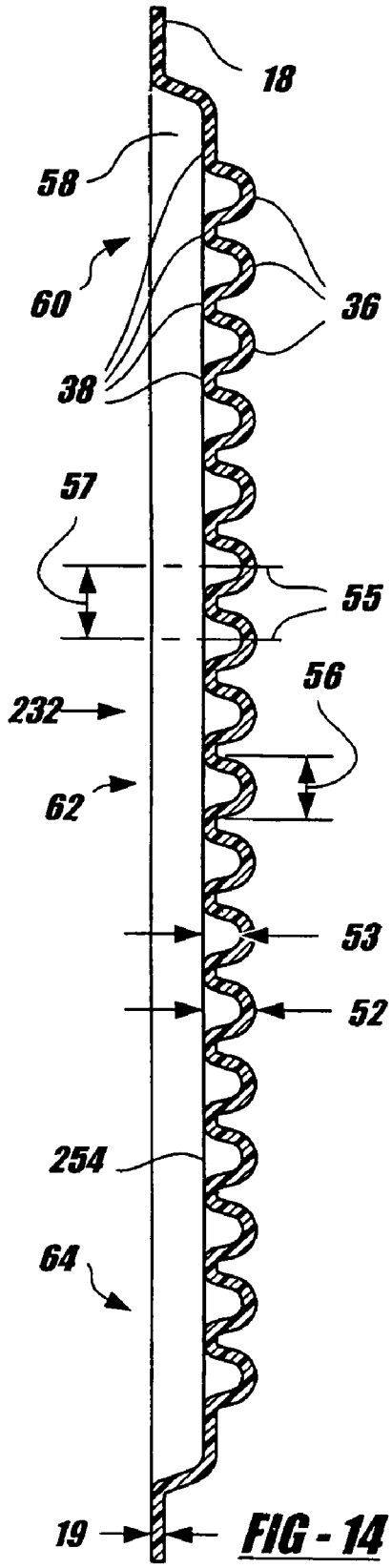
FIG. 14 is a cross-sectional view of an alternative inverting vacuum panel, taken generally along the line 14-14 of FIG. 11, the inverting vacuum panel shown as formed on the container sidewall, the container as molded and empty.

FIG. 14 illustrates vacuum panel embodiment 232 in longitudinal cross section wherein underlying surface 254 in cross section is substantially a straight line. However, underlying surface 254 retains a generally convex characteristic in the central portion 62 as shown in perpendicular cross section in FIG. 18.

Figure 15:
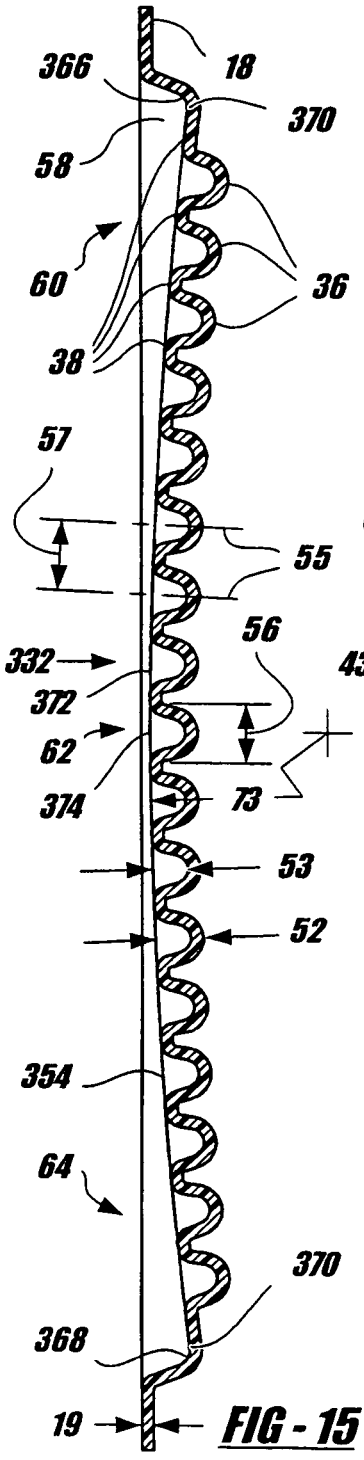
FIG. 15 is a cross-sectional view of an alternative inverting vacuum panel, taken generally along the line 15-15 of FIG. 11, the inverting vacuum panel shown as formed on the container sidewall, the container as molded and empty.

FIG. 15 illustrates vacuum panel embodiment 332 in longitudinal cross section having an underlying surface 354 that has a convex surface 372 with an apex 374. Concave surfaces 366 and 368 with apexes 370 correspond to a short radius curvature or fillet, which those skilled in the art expect as part of the transition between the underlying surface 354 and the perimeter wall 58. Underlying surface 354 retains a generally convex characteristic in the central portion 62 as shown in perpendicular cross section in FIG. 18.

Figure 16:
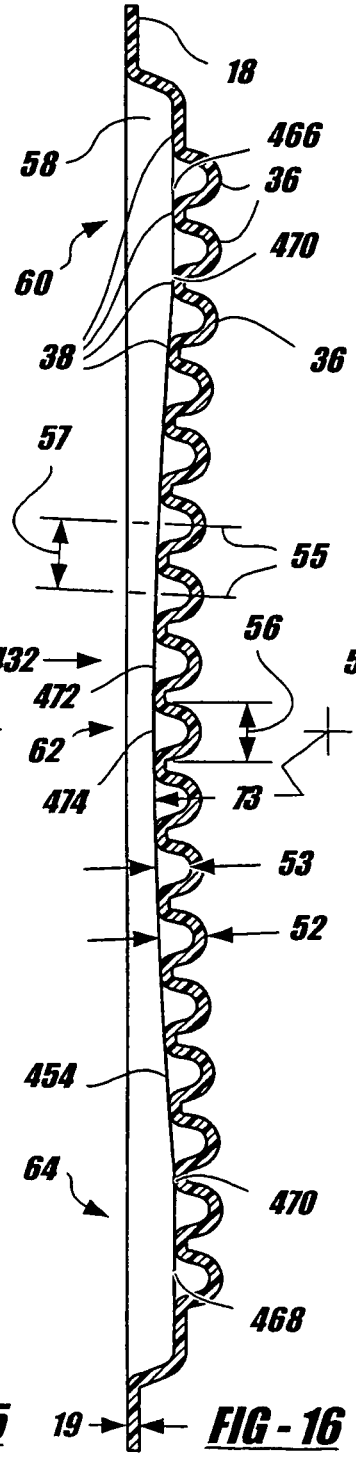
FIG. 16 is a cross-sectional view of an alternative inverting vacuum panel, taken generally along the line 16-16 of FIG. 11, the inverting vacuum panel shown as formed on the container sidewall, the container as molded and empty.

FIG. 16 illustrates vacuum panel embodiment 432 in longitudinal cross section having an underlying surface 454 with an apex 474. Concave surfaces 466 and 468 with apexes 470 are substantially a straight line. Underlying surface 454 retains its generally convex characteristic in the central portion 62 as shown in perpendicular cross section in FIG. 18.

Figure 17:
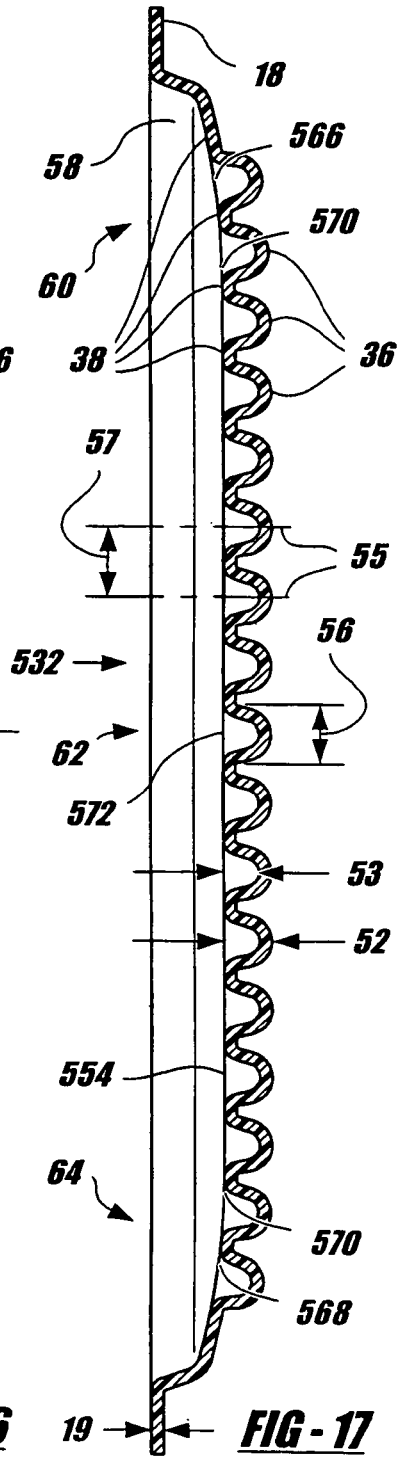
FIG. 17 is a cross-sectional view of an alternative inverting vacuum panel, taken generally along the line 17-17 of FIG. 11, the inverting vacuum panel shown as formed on the container sidewall, the container as molded and empty.

FIG. 17 illustrates vacuum panel embodiment 532 in longitudinal cross section having an underlying surface 554. In the central portion 62 of vacuum panel embodiment 532 is a straight portion 572. Upper portion 60 with concave surface 566 and lower portion 64 with concave surface 568 each have an apex 570 and merge with straight portion 572. Underlying surface 554 retains its generally convex characteristic in the central portion 62 as shown in perpendicular cross section in FIG. 18.

Figure 12:
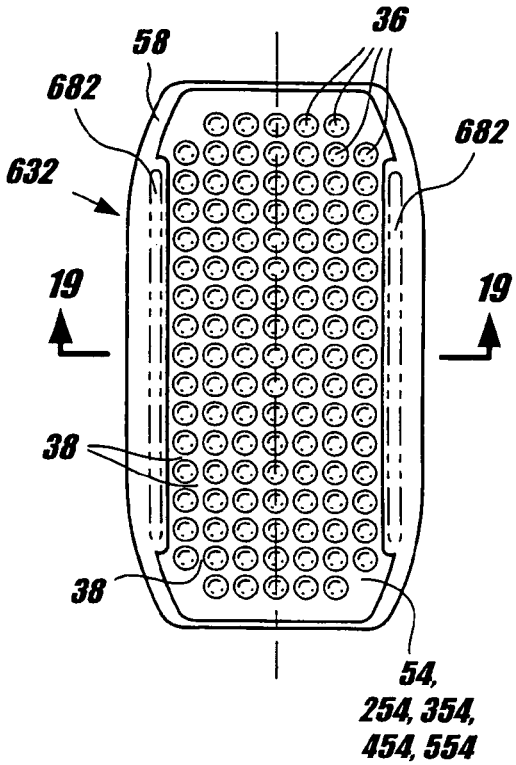
FIG. 12 is an elevational view of a single inverting vacuum panel alternative with side grooves.
Figure 19:
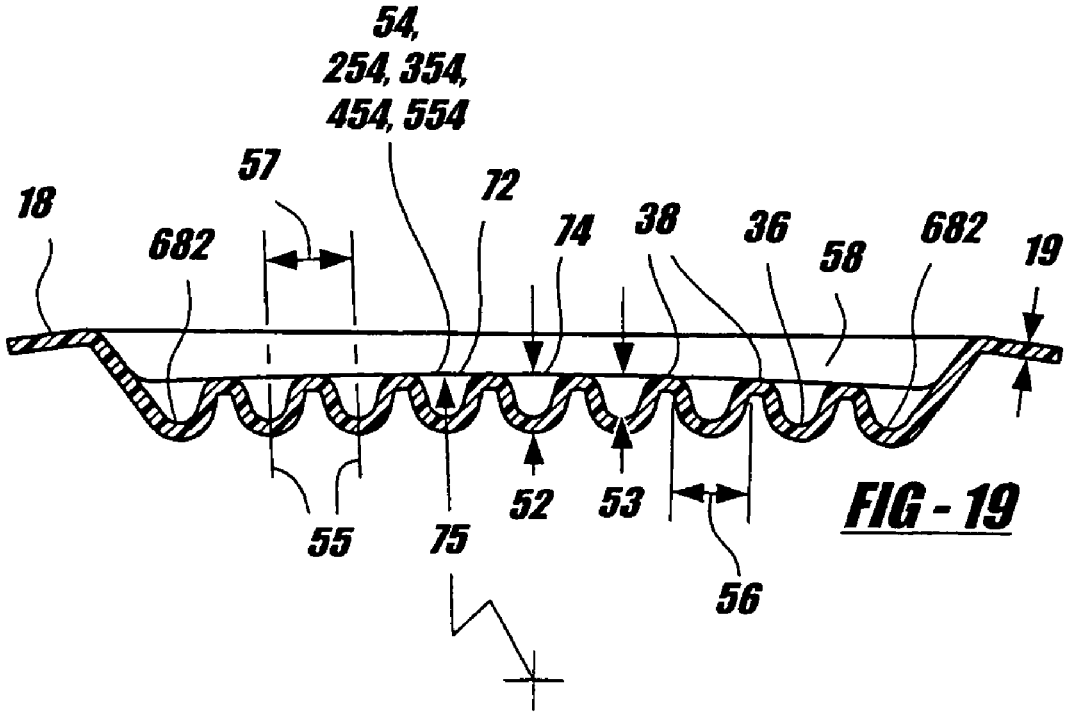
FIG. 19 is a cross-sectional view of the inverting vacuum panel alternative, taken generally along the line 19-19 of FIG. 12, the inverting vacuum panel shown as formed on the container sidewall, the container as molded and empty.

FIGS. 12 and 19 illustrate vacuum panel embodiment 632 having a pair of longitudinal grooves 682. Longitudinal grooves 682 are adjacent with dimples or indents 36 and join with perimeter wall 58. The addition of longitudinal grooves 682, having an inside depth approximately equal to the inside depth of indent 36, further facilitates in certain containers, vacuum panel inversion. The dimension of lands 38 between adjacent longitudinal grooves 682 and indents 36 is similar to the dimension of lands 38 between any other two adjacent indents 36 having pitch 57.

Figure 20:
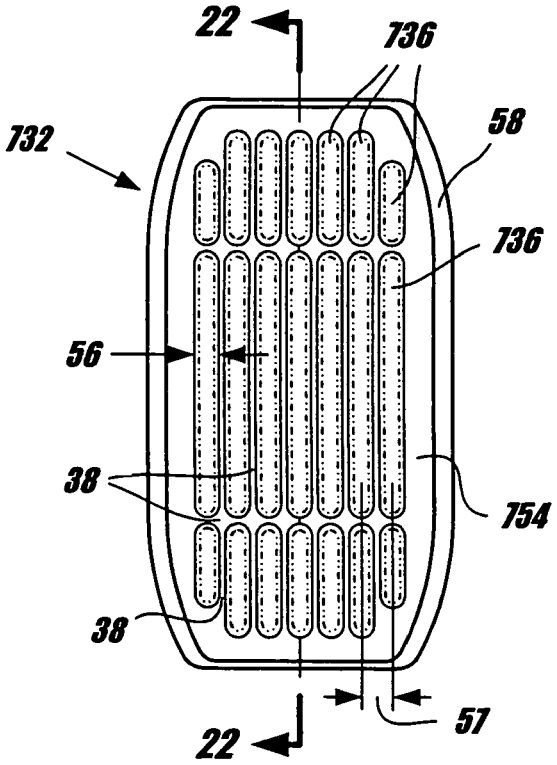
FIG. 20 is an elevational view of a single inverting vacuum panel alternative with groove indentations having longitudinally lengthwise alignment.
Figure 22:
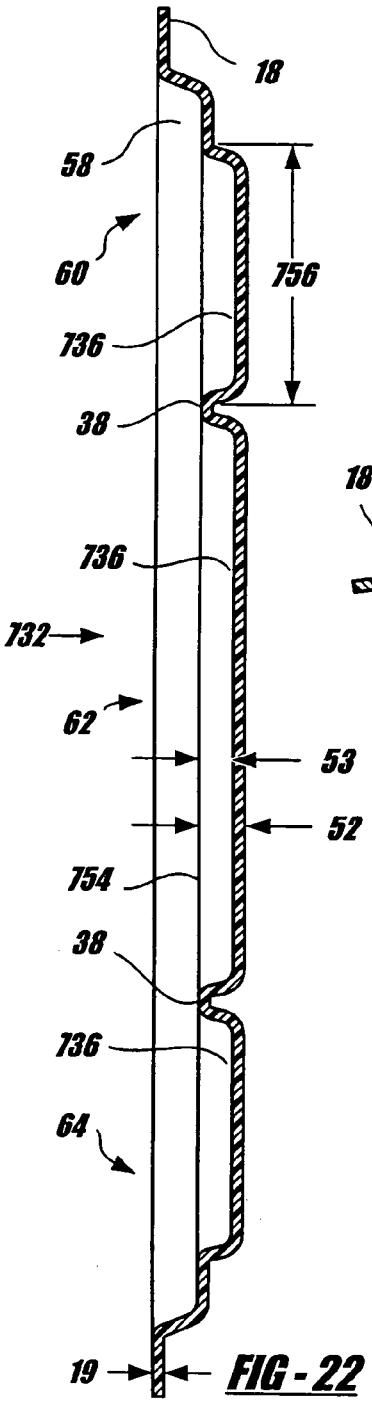
FIG. 22 is a cross-sectional view of the alternative inverting vacuum panel, taken generally along the line 22-22 of FIG. 20, the inverting vacuum panel shown as formed on the container sidewall, the container as molded and empty.

The inventors intended for vacuum panels 32, 132, 232, 332, 432, and 532, and variations relating to vacuum panels 632 to be significantly flexible and to readily invert when subjected to vacuum related forces created during hot-fill of a beverage, subsequent seal, and cool down of the container 10. The series of dimples or indents 36 with depth 52, length 56, and pitch 57 manipulate wall thickness 19 to provide additional flexibility to facilitate inversion. However, the inventors envision, that under certain conditions, a need exists to retard flexibility slightly. In other words, the vacuum panels previously described herein may become too flexible. Accordingly, an alternative vacuum panel embodiment 732 is shown in FIGS. 20 and 22 having a series of fused indents 736 aligned longitudinally. Each fused indent 736 has an equivalent size of two or more indents 36 fused together to form an elongated shape having a length 756. Otherwise, fused indents 736 have similar corresponding dimensional attributes as those found in indents 36 including dimension 56 (width of fused indent 736), depth 52, wall thickness 19, and pitch 57. While underlying surface 754 can assume a configuration in longitudinal cross section similar to any of the underlying surfaces 54, 254, 354, 454, and 554, previously discussed, disclosed, and shown in FIGS. 13, 14, 15, 16, and 17 respectively herein, the inventors envision a preferred configuration for underlying surface 754 similar to underlying surface 254 of FIG. 14. Moreover, underlying surface 754 of vacuum panel 732 retains a similar generally convex characteristic as shown in perpendicular cross section in FIG. 18. Those skilled in the art recognize a possibility of a vacuum panel having a combination of indents 36 and fused indents 736.

Figure 21:
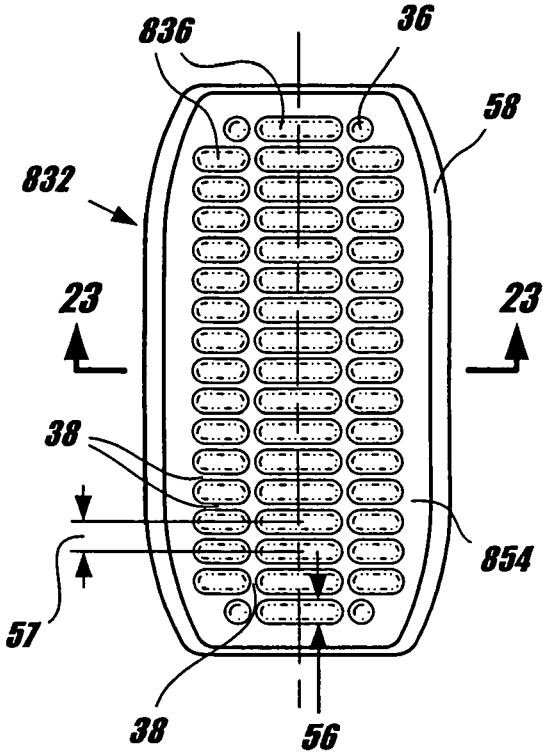
FIG. 21 is an elevational view of a single inverting vacuum panel alternative with groove indentations having athwart lengthwise alignment.
Figure 23:
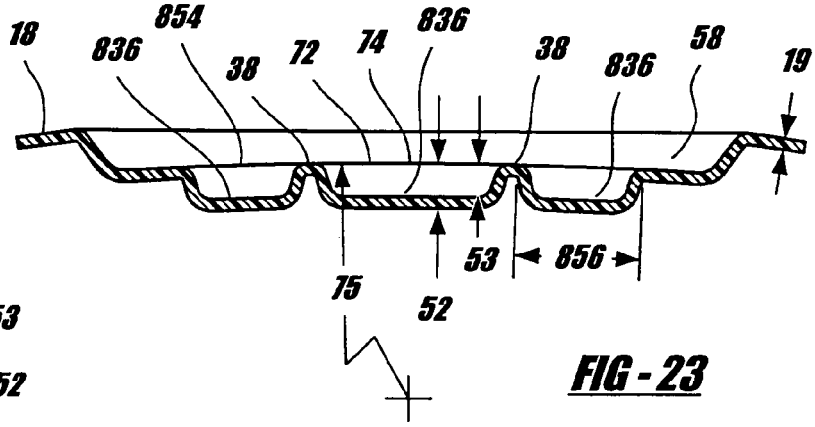
FIG. 23 is a cross-sectional view of the alternative inverting vacuum panel, taken generally along the line 23-23 of FIG. 21, the inverting vacuum panel shown as formed on the container sidewall, the container as molded and empty.

Another alternative vacuum panel embodiment 832 is shown in FIGS. 21 and 23 including a series of fused indents 836 having an athwart lengthwise alignment. Each fused indent 836 has an equivalent size of two or more indents 36 fused together to form an elongated shape having a length 856. Otherwise, fused indents 836 have similar corresponding dimensional attributes as those found in indents 36 including dimension 56 (width of fused indent 836), depth 52, wall thickness 19, and pitch 57. The underlying surface 854 can assume a configuration in longitudinal cross section similar to any of the underlying surfaces 54, 254, 354, 454, and 554, previously discussed, disclosed, and shown in FIGS. 13, 14, 15, 16, and 17 respectively herein. Moreover, the underlying surface 854 of vacuum panel 832 retains a similar generally convex characteristic as shown in perpendicular cross section in FIG. 23. Those skilled in the art recognize a possibility of a vacuum panel having a combination of indents 36 and fused indents 836.

While the above description constitutes the preferred embodiment and several alternative embodiments of the present invention, it will be appreciated that the invention is susceptible to modification, variation and change without departing from the proper scope and fair meaning of the accompanying claims.

What is claimed is:

1. A sidewall portion of a plastic container adapted for vacuum absorption, the container having an upper portion including a mouth defining an opening into the container, a lower portion forming a base, and the sidewall portion connected with and extending between the upper portion and the lower portion; the upper portion, the lower portion and the sidewall portion cooperating to define a receptacle chamber within the container into which product can be filled; said sidewall portion comprising a plurality of generally rectangular shaped vacuum panels formed therein, said vacuum panels defined in at least part by an upper portion, a central portion, and a lower portion, each such portion having an underlying surface with a series of equidistantly spaced indents formed therein arranged in horizontal rows and vertical columns wherein any two adjacent indents of said series of equidistantly spaced indents have a generally equidistant pitch, at least said central portion underlying surface having a generally convex shape in cross section, said vacuum panels being movable to accommodate vacuum forces generated within the container thereby decreasing the volume of the container.

2. The sidewall portion of claim 1 wherein said series of equidistantly spaced indents are generally circular in shape.

3. The sidewall portion of claim 1 wherein said series of equidistantly spaced indents each have an inside depth of between approximately 0.047 inch (1.19 mm) and approximately 0.067 inch (1.70 mm).

4. The sidewall portion of claim 1 wherein said generally equidistant pitch along any one of said horizontal rows is different from said generally equidistant pitch along any one of said vertical columns.

5. The sidewall portion of claim 4 wherein said pitch is between approximately 0.030 inch (0.76 mm) and approximately 0.090 inch (2.29 mm) along at least one of said one of said horizontal rows and said one of said vertical columns.

6. The sidewall portion of claim 1 wherein said series of equidistantly spaced indents include a series of fused indents of various elongated shapes aligned longitudinally with said vacuum panels.

7. The sidewall portion of claim 1 wherein said series of equidistantly spaced indents include a series of fused indents of various elongated shapes having an athwart lengthwise alignment.

8. The sidewall portion of claim 1 wherein said vacuum panels further include a perimeter wall, said perimeter wall being substantially adjacent to and generally surrounding said underlying surfaces, and having a filleted surface substantially therebetween.

9. The sidewall portion of claim 8 wherein said upper portion underlying surface and said lower portion underlying surface, in longitudinal cross section, have a generally reduced concave shape substantially corresponding with said filleted surface.

10. The sidewall portion of claim 8 wherein said vacuum panels each include a pair of longitudinal grooves, said longitudinal grooves adjacent with said indents and merging into said perimeter wall.

11. The sidewall portion of claim 10 wherein said series of equidistantly spaced indents each have an inside depth which is substantially equivalent to an inside depth of said longitudinal grooves.

12. The sidewall portion of claim 1 wherein said upper portion underlying surface and said lower portion underlying surface, in longitudinal cross section, have a generally concave shape.

13. The sidewall portion of claim 1 wherein said upper portion underlying surface, said central portion underlying surface, and said lower portion underlying surface, in longitudinal cross section, have a generally straight-line shape and, in perpendicular cross section, have a generally convex shape.

14. The sidewall portion of claim 1 wherein said upper portion underlying surface and said lower portion underlying surface, in longitudinal cross section, have a generally straight-line shape.

15. The sidewall portion of claim 1 wherein said upper portion underlying surface and said lower portion underlying surface each, in longitudinal cross section, have a concave shape and said central portion underlying surface has a straight-line shape; said upper portion underlying surface and said lower portion underlying surface each having an apex; said straight-line shape of said central portion underlying surface generally merging with said apex of said upper portion underlying surface and said apex of said lower portion underlying surface; and said central portion, in perpendicular cross section, having a generally convex shape.

16. The sidewall portion of claim 1 wherein material is thickest at a bottom portion of said indent and is thinnest at an area between said indents.

17. The sidewall portion of claim 1 wherein said central portion becomes generally concave shaped in cross section when accommodating said vacuum forces generated within said container.

18. The sidewall portion of claim 1 wherein said vacuum panels further include a central longitudinal axis and at least two islands located thereon.

19. A sidewall portion of a plastic container adapted for vacuum absorption, said sidewall portion comprising: a plurality of generally rectangular shaped vacuum panels formed therein, said vacuum panels defined in at least part by an upper portion, a central portion, and a lower portion, each such portion having an underlying surface with a series of generally circular and generally equidistantly spaced indents formed therein, said indents arranged in horizontal rows and vertical columns, at least said central portion underlying surface having a generally convex shape in cross section, said vacuum panels further including a perimeter wall substantially adjacent to and generally surrounding said underlying surfaces, and a pair of longitudinal grooves adjacent with said indents arranged in vertical columns and merging into said perimeter wall, said indents each having an inside depth which is substantially equivalent to an inside depth of said longitudinal grooves, said vacuum panels being movable to accommodate vacuum forces generated within the container thereby decreasing the volume of the container.

20. The sidewall portion of claim 19 wherein said upper portion underlying surface and said lower portion underlying surface each, in longitudinal cross section, have a concave shape and said central portion underlying surface has a straight-line shape; said upper portion underlying surface and said lower portion underlying surface each having an apex; said straight-line shape of said central portion underlying surface generally merging with said apex of said upper portion underlying surface and said apex of said lower portion underlying surface; and said central portion, in perpendicular cross section, having a generally convex shape.

21. The sidewall portion of claim 19 wherein said series of generally circular and generally equidistantly spaced indents have a first pitch between adjacent indents along any one of said horizontal rows, said first pitch is different from a second pitch defined between adjacent indents along any one of said vertical columns.

22. The sidewall portion of claim 21 wherein said first pitch and said second pitch is between approximately 0.030 inch (0.76 mm) and approximately 0.090 inch (2.29 mm).

23. The sidewall portion of claim 19 wherein said series of generally circular and generally equidistantly spaced indents each have an inside depth of between approximately 0.047 inch (1.19 mm) and approximately 0.067 inch (1.70 mm).

24. The sidewall portion of claim 19 wherein material is thickest at a bottom portion of said indent and is thinnest at an area between said indents.

25. The sidewall portion of claim 19 wherein said central portion becomes generally concave shaped in cross section when accommodating said vacuum forces generated within the container.

26. A sidewall portion of a plastic container adapted for vacuum absorption, said sidewall portion comprising: a plurality of generally rectangular shaped vacuum panels formed therein, said vacuum panels defined in at least part by an upper portion, a central portion, and a lower portion, each such portion having an underlying surface with a series of generally equidistantly spaced indents formed therein, said indents arranged in horizontal rows and vertical columns, at least said central portion underlying surface having a generally convex shape in cross section, and a perimeter wall substantially adjacent to and generally surrounding said underlying surfaces, and a pair of longitudinal grooves adjacent with said series of generally equidistantly spaced indents and merging into said perimeter wall, said indents having an inside depth which is substantially equivalent to an inside depth of said longitudinal grooves, said vacuum panels being movable to accommodate vacuum forces generated within the container thereby decreasing the volume of the container.

27. The sidewall portion of claim 26 wherein material is thickest at a bottom portion of said indent and is thinnest at an area between said indents.

28. The sidewall portion of claim 26 wherein said upper portion underlying surface and said lower portion underlying surface each, in longitudinal cross section, have a concave shape and said central portion underlying surface has a straight-line shape; said upper portion underlying surface and said lower portion underlying surface each having an apex; said straight-line shape of said central portion underlying surface generally merging with said apex of said upper portion underlying surface and said apex of said lower portion underlying surface; and said central portion, in perpendicular cross section, having a generally convex shape.

29. A sidewall portion of a plastic container adapted for vacuum absorption, the container having an upper portion including a mouth defining an opening into the container, a lower portion forming a base, and the sidewall portion connected with and extending between the upper portion and the lower portion; the upper portion, the lower portion and the sidewall portion cooperating to define a receptacle chamber within the container into which product can be filled; said sidewall portion comprising a plurality of vacuum panels formed therein, said vacuum panels defined in at least part by an upper portion, a central portion, and a lower portion, each such portion having an underlying surface with a series of equidistantly spaced indents formed therein arranged in horizontal rows and vertical columns wherein any two adjacent indents of said series of equidistantly spaced indents have a generally equidistant pitch, at least said central portion underlying surface having a generally convex shape in cross section, and said upper portion underlying surface and said lower portion underlying surface having a generally straight-line shape in cross section, said vacuum panels being movable to accommodate vacuum forces generated within the container thereby decreasing the volume of the container.

30. The sidewall portion of claim 29 wherein said series of equidistantly spaced indents include a series of fused indents of various elongated shapes aligned longitudinally with said vacuum panels.

31. The sidewall portion of claim 29 wherein said series of equidistantly spaced indents include a series of fused indents of various elongated shapes having an athwart lengthwise alignment.

32. A sidewall portion of a plastic container adapted for vacuum absorption, said sidewall portion comprising: a plurality of vacuum panels formed therein, said vacuum panels defined in at least part by an upper portion, a central portion, and a lower portion, each such portion having an underlying surface with a series of generally circular and generally equidistantly spaced indents formed therein, said indents arranged in horizontal rows and vertical columns having a first pitch between adjacent indents along any one of said horizontal rows, said first pitch is different from a second pitch defined between adjacent indents along any one of said vertical columns, at least said central portion underlying surface having a generally convex shape in cross section, said vacuum panels further including a perimeter wall substantially adjacent to and generally surrounding said underlying surfaces, and a pair of longitudinal grooves adjacent with said indents arranged in vertical columns and merging into said perimeter wall, said vacuum panels being movable to accommodate vacuum forces generated within the container thereby decreasing the volume of the container.

* * * * *